US008820011B1

(12) United States Patent
Parks

(10) Patent No.: US 8,820,011 B1
(45) Date of Patent: Sep. 2, 2014

(54) STAGE FLOOR ASSEMBLY AND METHOD OF MAKING THE SAME

(71) Applicant: Steven A Parks, Fredericksburg, VA (US)

(72) Inventor: Steven A Parks, Fredericksburg, VA (US)

( * ) Notice: Subject to any disclaimer, the term of this patent is extended or adjusted under 35 U.S.C. 154(b) by 0 days.

(21) Appl. No.: 13/954,971

(22) Filed: Jul. 30, 2013

(51) Int. Cl.
*E04B 5/43* (2006.01)
*E04F 15/02* (2006.01)
*E04F 15/024* (2006.01)

(52) U.S. Cl.
CPC ..... *E04F 15/02183* (2013.01); *E04F 15/0247* (2013.01)
USPC ..... 52/263; 52/126.6

(58) Field of Classification Search
USPC ..... 52/126.1, 126.4, 126.5, 126.6, 126.7, 52/262–263, 127.1, 127.7, 127.12, 220.1, 52/745.05, 99–100, 241; 248/188, 188.2, 248/188.3, 188.4, 357, 354.3, 354.4
See application file for complete search history.

(56) References Cited

U.S. PATENT DOCUMENTS

| | | | | |
|---|---|---|---|---|
| 3,318,057 | A | 5/1967 | Norsworthy | |
| 4,085,557 | A | 4/1978 | Tharp et al. | |
| 4,277,923 | A | 7/1981 | Rebentisch et al. | |
| 4,458,463 | A * | 7/1984 | Behrend | 52/295 |
| 4,895,335 | A * | 1/1990 | Oliver | 248/354.3 |
| 4,922,670 | A | 5/1990 | Naka et al. | |
| 4,982,539 | A * | 1/1991 | Hiller | 52/263 |
| 4,996,804 | A * | 3/1991 | Naka et al. | 52/126.6 |
| 5,459,968 | A * | 10/1995 | Jin | 52/126.6 |
| 5,477,649 | A * | 12/1995 | Bessert | 52/263 |
| D370,060 | S * | 5/1996 | Fahy, Jr. | D25/128 |
| 5,644,879 | A | 7/1997 | Shreiner et al. | |
| 5,791,096 | A * | 8/1998 | Chen | 52/126.6 |
| 5,983,582 | A | 11/1999 | Vugrek | |
| 6,106,186 | A | 8/2000 | Taipale et al. | |
| 6,336,296 | B1 | 1/2002 | Ishibashi et al. | |
| 7,546,715 | B2 | 6/2009 | Roen | |
| 8,156,696 | B2 | 4/2012 | Hubbard et al. | |
| 8,162,569 | B2 | 4/2012 | Kennedy et al. | |
| 8,181,399 | B2 | 5/2012 | Knight, III et al. | |
| 8,387,317 | B2 | 3/2013 | Kugler et al. | |
| 2009/0184614 | A1 * | 7/2009 | Walsberg | 312/351.3 |
| 2010/0089229 | A1 | 4/2010 | Ackerman et al. | |

FOREIGN PATENT DOCUMENTS

| | | | |
|---|---|---|---|
| JP | 06073817 | A | 7/1992 |
| JP | 11062195 | A | 3/1999 |
| JP | 11071889 | A | 3/1999 |

* cited by examiner

*Primary Examiner* — William Gilbert
*Assistant Examiner* — Beth Stephan
(74) *Attorney, Agent, or Firm* — Law Office of Michael O'Brien

(57) ABSTRACT

A stage floor assembly can be easily assembled, aligned and adjusted even on an uneven surface. The stage floor assembly includes a plurality of pedestals with each pedestal further comprising a pedestal base attached to a plurality of rods. There is a plurality of stringers placed upon some of the plurality of rods such that two stringers terminate at each pedestal and one stringer crosses two rods on each pedestal forming a grid network that self-aligns even on the uneven surface. A plurality of deck plates is attached to the plurality of stringers creating a surface to absorb and distribute loads across pedestals preventing noticeable deflection across the stage floor assembly.

11 Claims, 7 Drawing Sheets

STAGE FLOOR ASSEMBLY AND METHOD OF MAKING THE SAME

BACKGROUND

The embodiments herein relate generally to a new surface raised above an existing surface.

Prior to embodiments of the disclosed invention, stage floors were challenging to assemble, align and adjust because of a mistaken theory of nodal assembly that plagues the prior art. Nodal assembly is the theory that a stage floor consists of stringers arranged in rows, columns and, in some cases, diagonals that intersect at nodes where either all the stringers terminate or all the stringers in a single direction terminate. The prior art includes: U.S. Pat. No. 5,983,582 issued to Vugrek; U.S. Pat. No. 8,162,569 issued to Kennedy; U.S. Pat. No. 6,336,296 issued to Ishibashi; U.S. Pat. No. 4,277,923 issued to Irish; European Patent Application 0529073 filed by Haka; U.S. Patent Application Publication 2010/0089229 filed by Ackerman; U.S. Pat. No. 4,085,557 filed by Tharp; U.S. Pat. No. 7,546,715 issued to Roen; U.S. Pat. No. 6,106,186 issued to Jines; U.S. Pat. No. 4,922,670 issued to Naka; U.S. Pat. No. 3,318,057 issued to Norsworthy; U.S. Pat. No. 8,156,696 issued to Hubbard; U.S. Pat. No. 8,181,399 issued to Knight; U.S. Pat. No. 8,387,317 issued to Kugler; and U.S. Pat. No. 5,644,879 issued to Barr.

Elevated building surfaces such as elevated floors, decks, terraces and walkways are desirable in many environments. Prior art decks, such as Irish, essentially rely on having elongated members terminate at each node. This construction leads to a substantial time sink in assembly, and a low strength to weight ratio. The present invention solves this problem.

Vugrek, Norsworthy an Ishibashi teach a series of pedestals that can be interconnected by a series of stringers. Haka adds the support members but has them terminate at each node, much like Irish. Tharp likewise adds a top plate to assist in uniform floor height but does not have a theory as how this could help loading. Naka, Jines and Kugler add an elaborate keying system to that but each member continues to terminate at each node. Knight proffers to add stability by wrapping the stringers partially around the pedestals. Barr proffers to add stability by adding an expansion joint at each pedestal. In each of these, the pedestals are arranged in rows with each stringer transiting from one pedestal to another but no stringer connects three pedestals, indeed three adjacent pedestals are not shown at all.

Both Ackerman and Kennedy teach a bulkhead for a safe room that utilizes a series of nodes that are bolted to a number of elongated members as a cross bar that runs indefinitely along a wall. If such a construction would be applied to a floor there would be no modular theory of assembly resulting in a substantial time to assemble, further, there would be substantial deflection in the deck when compared to embodiments of the present invention.

Roen tries to combine the teaching of the continuous rails in Ackerman and Kennedy with the floor teaching of Vugrek, Norsworthy an Ishibashi, and concludes that the best way to do this does so by having a plurality of parallel members resting on top of a plurality of perpendicular members. While this enables a key system as in Naka, Jines and Kugler for sliding floor panels, those panels are still only supported by the keys in the upper member and would deflect under moderate loading.

Hubbard teaches a floor system that involves a series of continuous parallel members that cross many nodes separated by a series of perpendicular members that terminate at each node. Rather than utilizing an anchor for structural support, Hubbard teaches a central hub that is connected to a pneumatic shock absorber and then a series of struts and pads are adjacent to pedestals. It is specious as to whether this works and Hubbard offers no testing results. More likely, the arrangement of the perpendicular members renders the device likely to fail at those nodes away from the pedestals.

SUMMARY

A stage floor assembly can be easily assembled, aligned and adjusted even on an uneven surface. The stage floor assembly includes a plurality of pedestals with each pedestal further comprising a pedestal base attached to a plurality of rods. There is a plurality of stringers placed upon some of the plurality of rods such that two stringers terminate at each pedestal and one stringer crosses two rods on each pedestal forming a gird network which self-aligns even on the uneven surface. A plurality of deck plates is attached to the plurality of stringers creating a surface to absorb and distribute loads across pedestals preventing an unacceptable deflection across the stage floor assembly.

In some embodiments, the plurality of rods further comprises a plurality of threaded rods and a first plurality of unthreaded rods. The plurality of threaded rods can be mechanically coupled to a pedestal cover with threaded fasteners in order to keep the stage floor assembly at a consistent height. An angular support is mechanically coupled to a first unthreaded rod on a first pedestal and second unthreaded rod on a second pedestal in order to align the first pedestal to the second pedestal as well as to disperse loading from the first pedestal and the second pedestal. The angular support further defines a diagonal between the opposite corners of the basic floor subassembly square. This diagonal being fixed to the pedestals at the opposite corners rigidly constrains the subassembly ensuring the support grid subassembly remains square.

In some embodiments, the plurality of stringers are connected to the threaded rods. The pedestal cover is further mechanically coupled to a second plurality of unthreaded rods in order to match the first plurality of unthreaded rods to better secure the angular support. The stage floor assembly distributes loads from the pedestals to the plurality of stringers and the angular support to resist damage during exposure to loading from an explosive blast.

During exposure to explosive blast, the floor grid, with decking and pedestal cover plates installed, will react as a continuous membrane and will flex without separating into discrete components that could become missile hazards. This membrane action is enabled by the interconnected nature of the floor support grid where a continuous stringer crosses each pedestal and two similar stringers terminate at the same pedestal. This construction results in a support grid that is at once directly interconnected with a continuous stringer into each adjacent subassembly square. This construction will resist damage during exposure to explosive blast in a manner superior to previous floor designs consisting of discrete square floor subassemblies connected to each other by clips, threaded fasteners, or cam lock systems.

A method of assembling a stage floor allows a user to assemble, align and adjust the stage floor. The method comprises the following steps, not necessarily in order: First a user places a first pedestal, a second pedestal, a third pedestal, and a fourth pedestal on ground in a location where a stage floor is desired. Next the user, connects the first pedestal and the fourth pedestal with a first stringer such that the first stringer passes through the fourth pedestal and terminates at the first pedestal. Then the user connects the first pedestal and the second pedestal with a second stringer such that the second stringer passes through the first pedestal and terminates at the second pedestal. After this the user connects the second pedestal and the third pedestal with a third stringer such that the third stringer passes through the second pedestal and terminates at the third pedestal. Next the user connects the third pedestal and the fourth pedestal with a fourth stringer such that the fourth stringer passes through the third pedestal and terminates at the fourth pedestal. After this a user can attach a deck plate to the first pedestal, the second pedestal, the third pedestal and the fourth pedestal.

In some embodiments, the user can attach an angular support to the first pedestal and the third pedestal. Depending on the height of the surface a user can adjust the pedestal height to ensure the deck plate is level.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
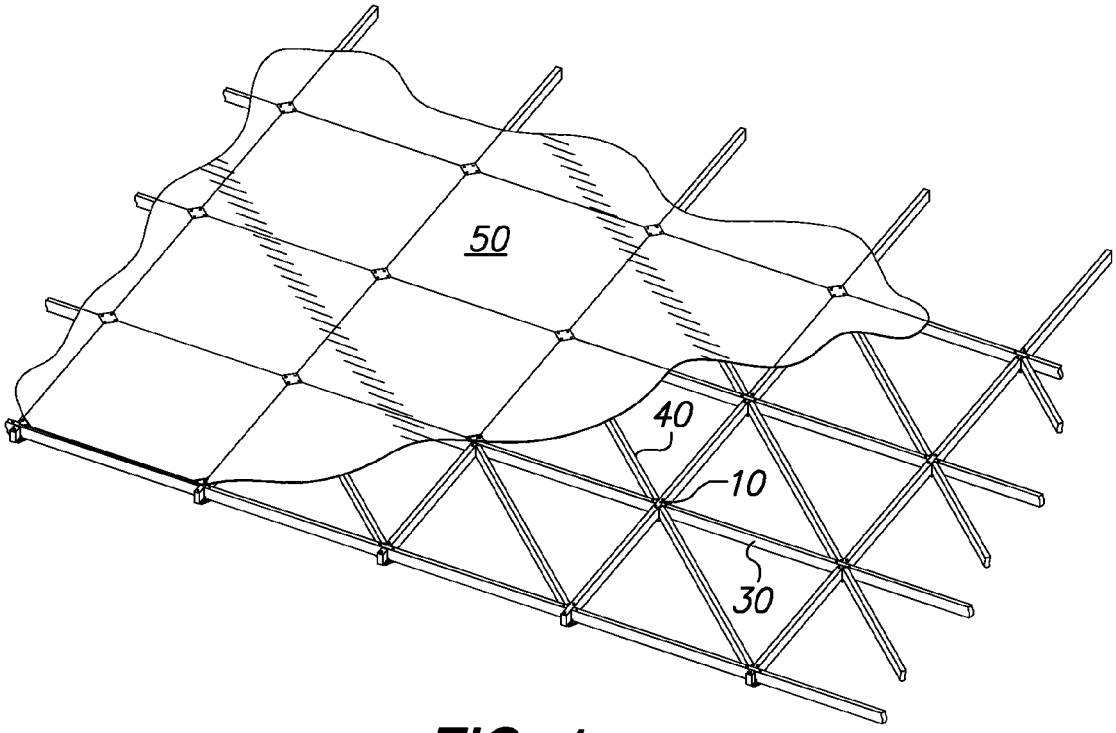
FIG. 1 shows a perspective view of one embodiment of the present invention.
Figure 2:
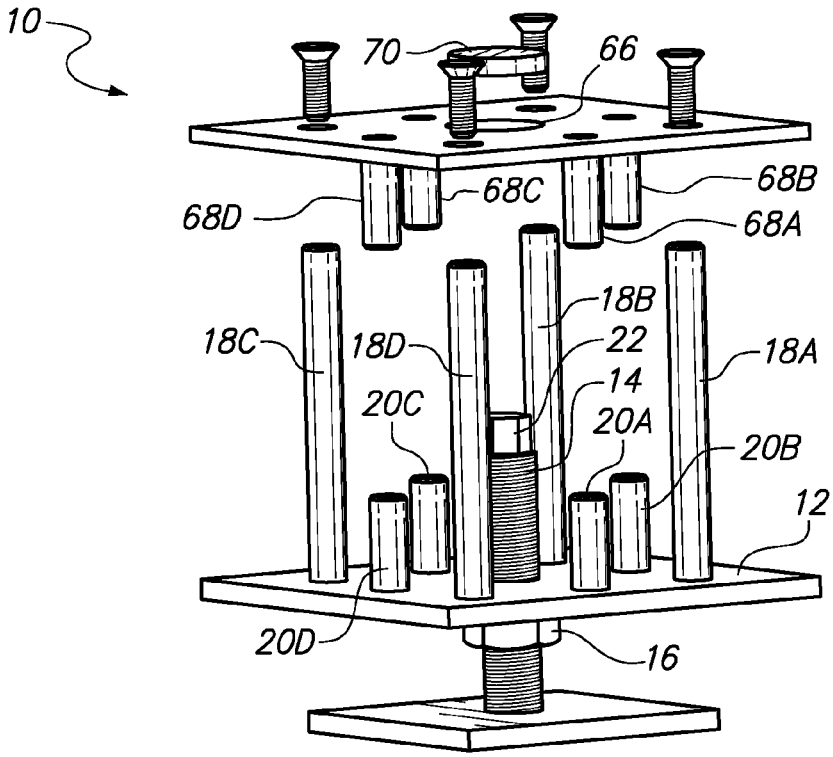
FIG. 2 shows an assembly view of the pedestal.
Figure 3:
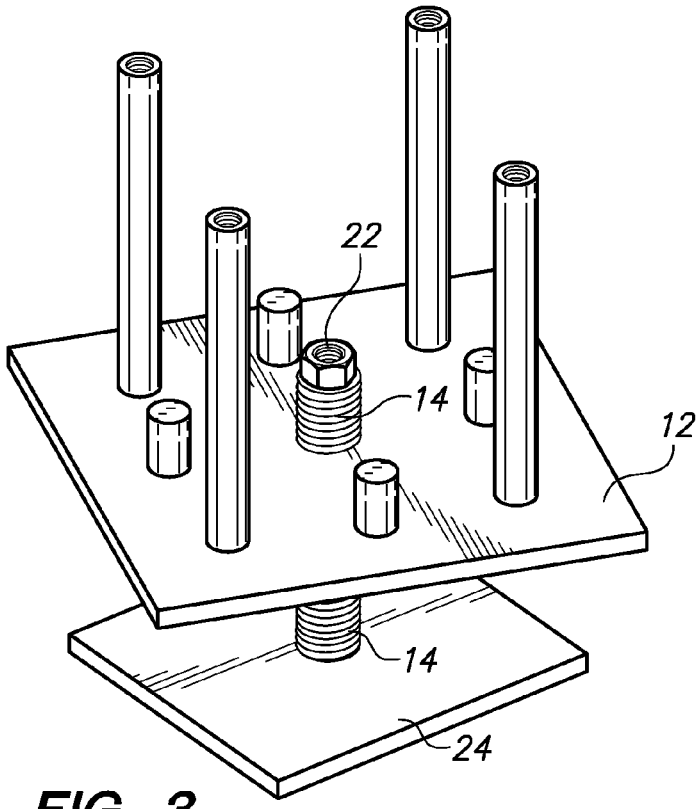
FIG. 3 a perspective view of the pedestal.
Figure 11:
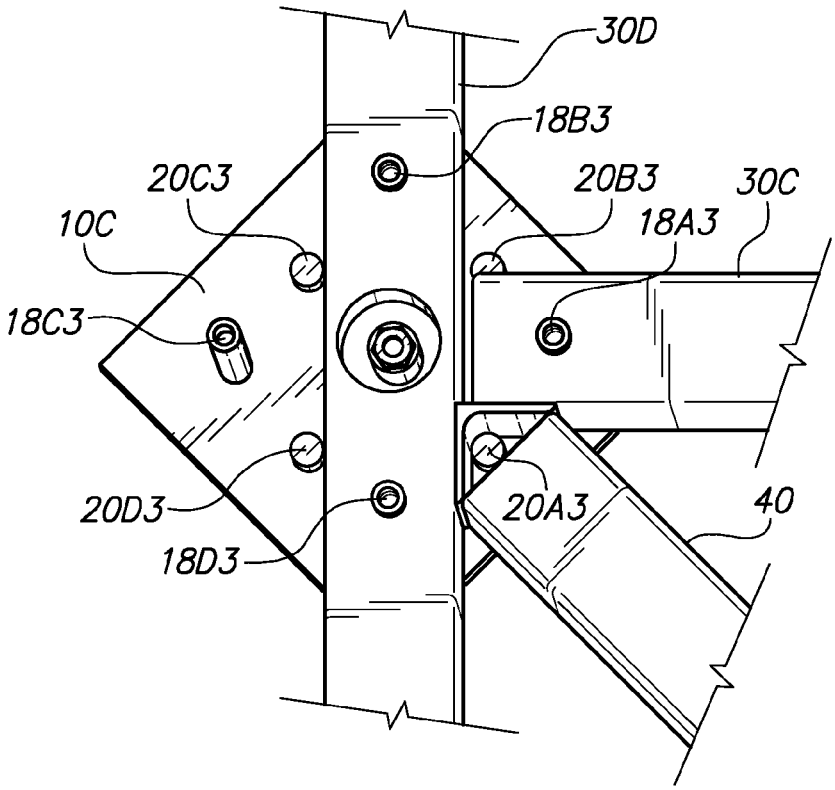
FIG. 11 shows a top view of one embodiment of the present invention.
Figure 12:
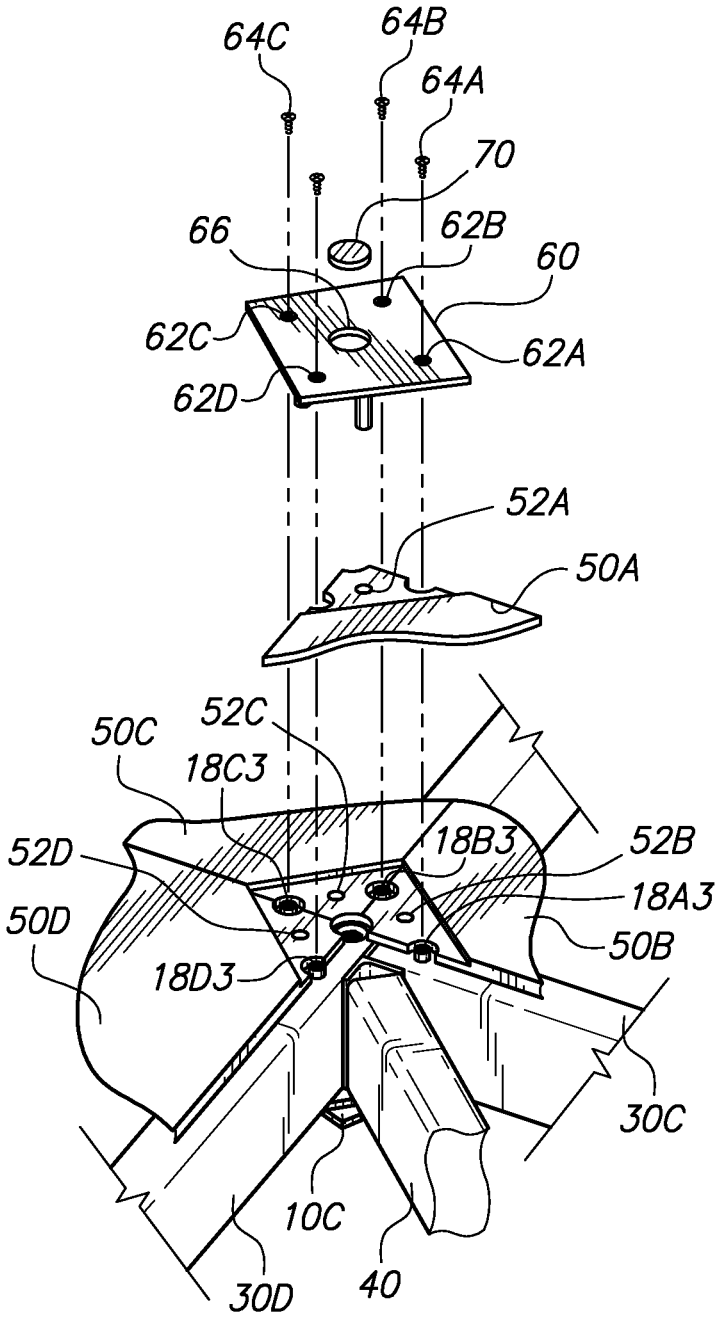
FIG. 12 shows an assembly view of one embodiment of the present invention.

By way of example, and referring to FIG. 1, one embodiment of the present system comprises a plurality of pedestals 10 are connected by stringers 30 and angular supports 40 to create a framework that can further accommodate a plurality of stage floor plates 50. FIG. 2 and FIG. 3 show pedestal 10 in more detail. FIG. 4, FIG. 5, FIG. 6, FIG. 7, FIG. 8, FIG. 9 and FIG. 10, show assembly views of the self-aligning feature of the stage floor assembly. FIG. 11 demonstrates one way angular support 40 can be used to both align and distribute loads from pedestal 10. FIG. 12 shows how top plate 60 can be utilized to cover pedestal 10, but still allow access to pedestal 10 for adjustments. While stringers 30 are usually the same length some stringers 30 will terminate a few inches past the pedestal 10, rather than extending outward a uniform length.

FIG. 2 and FIG. 3 show pedestal 10 in more detail, pedestal foot 24 is mechanically coupled to threaded rod 14. Threaded rod 14 is further mechanically coupled to rotation nut 22. In some embodiments, pedestal foot 24, threaded rod 14 and rotation nut 22 can be machined as a single unit or can be two or three units connected together, for example, by welding.

Pedestal 10 further comprises pedestal base 12 mechanically coupled to threaded nut 16. Threaded nut 16 is machined to be coupled to threaded rod 14. Thus a user can affix pedestal base 12 to threaded rod 14 by rotating threaded nut 16 around threaded rod 14.

Pedestal base 12 is further mechanically coupled to first threaded pedestal rod 18A, second threaded pedestal rod 18B, third threaded pedestal rod 18C and fourth threaded pedestal rod 18D. Threaded pedestal rods 18 can be used to align stringers 30 as shown in FIGS. 4 through 12 below.

Figure 9:
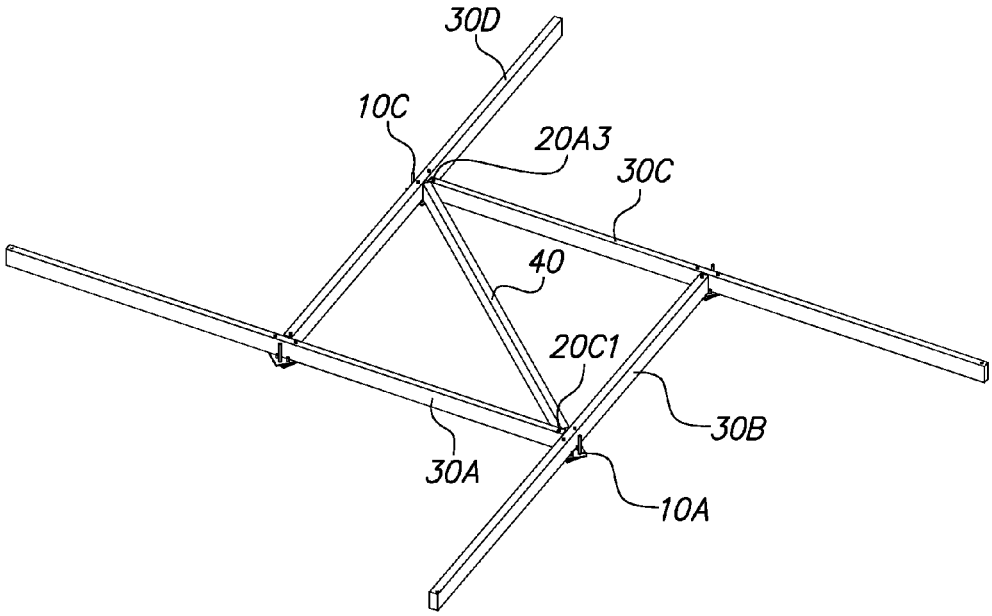
FIG. 9 shows a perspective view of one embodiment of the present invention.

Pedestal base 12 is further mechanically coupled to first unthreaded pedestal rod 20A, second unthreaded pedestal rod 20B, third unthreaded pedestal rod 20C and fourth unthreaded pedestal rod 20D. Unthreaded pedestal rods 20 can be used to accommodate angular supports 40 as shown in FIGS. 9, 11 and 12 below.

In some embodiments, pedestal base 12 is perforated with a pedestal base hole which can be an unthreaded hole which can be immediately adjacent to threaded nut 16. The unthreaded hole can be immediately adjacent to threaded rod 14. pedestal base 12 can be mechanically coupled to threaded pedestal rods 18 and unthreaded pedestal rods 20 by either machining pedestal base 12 as a single unit or by combining multiple units connected together, for example, by welding. Threaded pedestal rods 18 are bored with a threaded cavity that can accommodate threaded fasteners 64.

Turning to FIG. 2 and FIG. 12 pedestal base 12 can be covered with pedestal cover 60. Pedestal cover 60 is mechanically coupled to first unthreaded cover rod 68A, second unthreaded cover rod 68B, third unthreaded cover rod 68C and fourth unthreaded cover rod 68D. Unthreaded cover rods 68 can be used to accommodate angular supports 40 as shown in FIGS. 9, 11 and 12 below.

Pedestal cover 60 is perforated with first fastener hole 62A, second fastener hole 62B, third fastener hole 62C, and fourth fastener hole 62D. The fastener holes 62 are sufficiently large to accommodate a threaded fastener 64.

A user can mechanically couple pedestal cover 10 to threaded rods 18 in the following manner, a user can insert first threaded fastener 64A through first fastener hole 62A and into first threaded rod 18A. Similarly, a user can insert second threaded fastener 64A through second fastener hole 62A and into second threaded rod 18A. Likewise, a user can insert third threaded fastener 64A through third fastener hole 62A and into third threaded rod 18A. Finally, a user can insert fourth threaded fastener 64A through fourth fastener hole 62A and into fourth threaded rod 18A.

In one distinct advantage over the prior art the user can remove cover cap 70 covering central cover hole 66 giving the user access rotation nut 22. When the user turns rotation nut 22 and pedestal plate 12 is held in place then pedestal plate 12 will not rotate, but pedestal foot 24 will rotate and will move proximate or distant pedestal plate 12 depending on the direction turned. This enables a user to perform pedestal height adjustments from a completed stage floor assembly and to ensure that a plurality of pedestals are at a consistent height.

Figure 4:
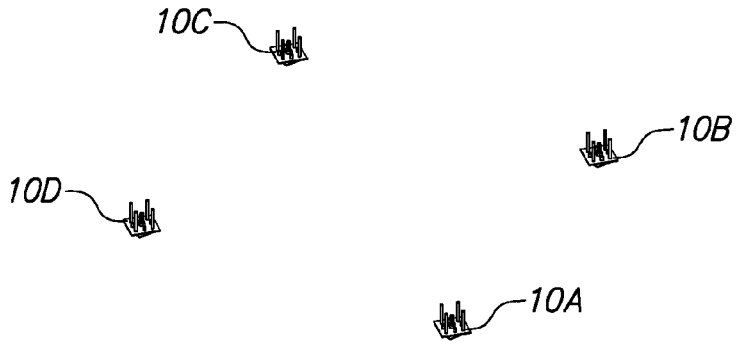
FIG. 4 shows a perspective view of one embodiment of the present invention.

Turning to FIG. 4, to assembly the deck a user first places a plurality of pedestals 10 in a location roughly were nodes are planned to be. This does not need to be flat since embodiments of the present invention can easily accommodate an uneven surface. Here the pedestals are marked first pedestal 10A, second pedestal 10D, third pedestal 10C and fourth pedestal 10B. There is no need to measure to be exact, since the pedestals can be easily moved and stingers 30, as noted below, are self-aligning.

Figure 5:
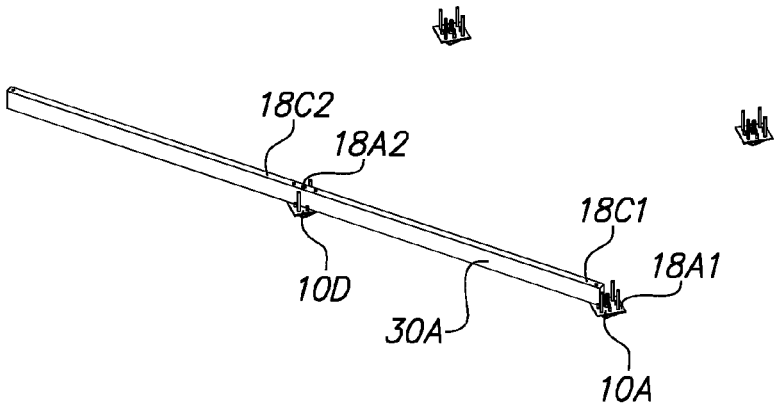
FIG. 5 shows a perspective view of one embodiment of the present invention.

Turning to FIG. 5 and FIG. 11, a user next connects two or three pedestals 10 with stringer 30. Stringer 30 is a support member with five perforations. Four perforations are sufficiently large to accommodate a threaded rod 18. The fifth perforation is sufficiently large to accommodate rotation nut 22. The first perforation is proximate a first end such that the distance from the perforation to the first end is approximately one half the distance from threaded rod 18 to rotation nut 22. The second perforation is proximate a second end such that the distance from the perforation to the second end is approximately one half the distance from threaded rod 18 to rotation nut 22. The third and fourth perforations are aligned to be a threaded rod diagonal distance apart. The threaded rod diagonal distance is equal to the distance between threaded rod 18A and threaded rod 18C or the distance between threaded rod 18B and threaded rod 18D.

In FIG. 5, a user puts the first stringer hole onto first pedestal third threaded rod 18C1 on first pedestal 10A. A user then places the third stringer hole and the fourth stringer hole onto second pedestal first threaded rod 18A2 and second pedestal third threaded rod 18C2 on second pedestal 10D.

Figure 6:
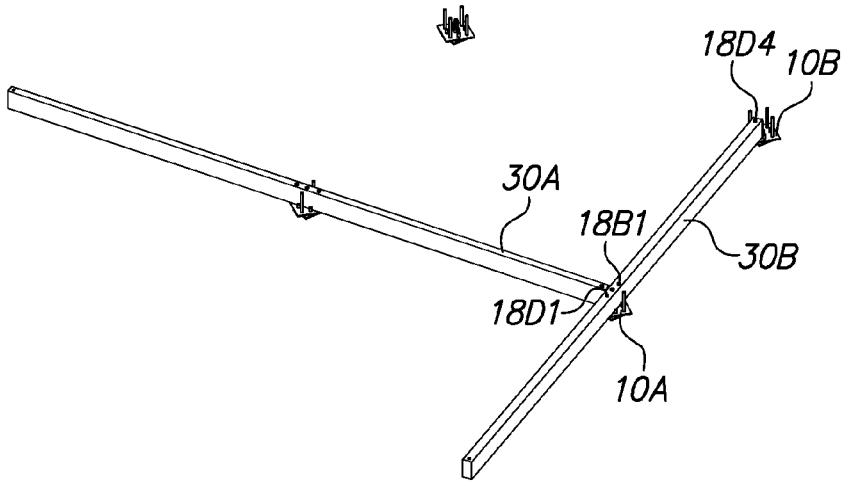
FIG. 6 shows a perspective view of one embodiment of the present invention.

Turning to FIG. 6, a user next places second stringer 30B perpendicular to first stringer 30A on first pedestal 10A such that the second stringer third hole fits over first pedestal fourth threaded rod 18D1 and the second stringer fourth hole fits over first pedestal second threaded rod 18B1 on first pedestal 10A. Then the user places the second stringer fourth hole over fourth pedestal fourth threaded rod 18D4 on fourth pedestal 10B.

Figure 7:
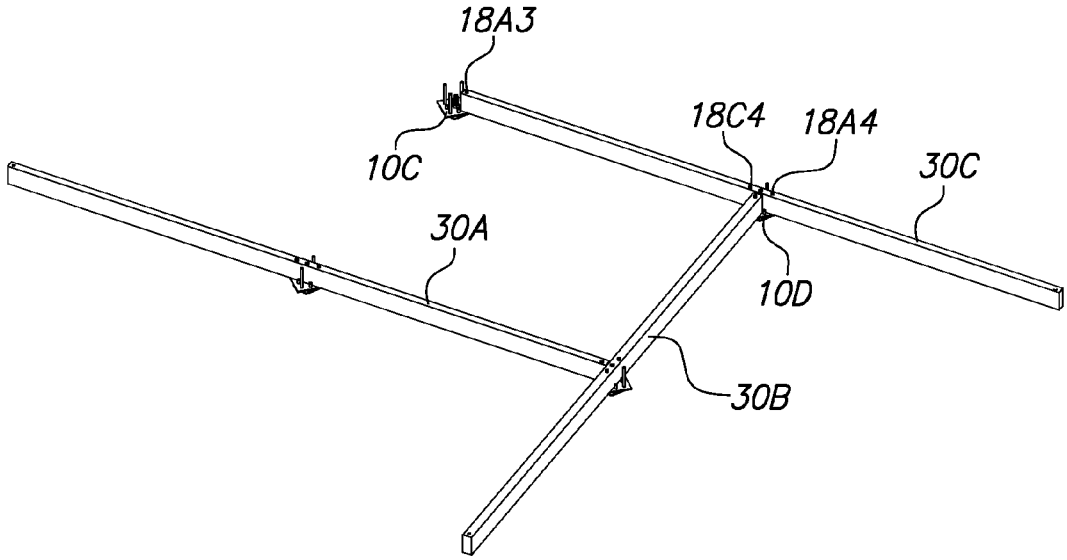
FIG. 7 shows a perspective view of one embodiment of the present invention.

Turning to FIG. 7, a user next places third stringer 30C perpendicular to second stringer 30B on second pedestal 10D such that the third stringer third hole fits over fourth pedestal first threaded rod 18A4 and the third stringer fourth hole fits over fourth pedestal third threaded rod 18C4 on second pedestal 10D. Then the user places the third stringer fourth hole over third pedestal first threaded rod 18A3 on third pedestal 10C.

Figure 8:
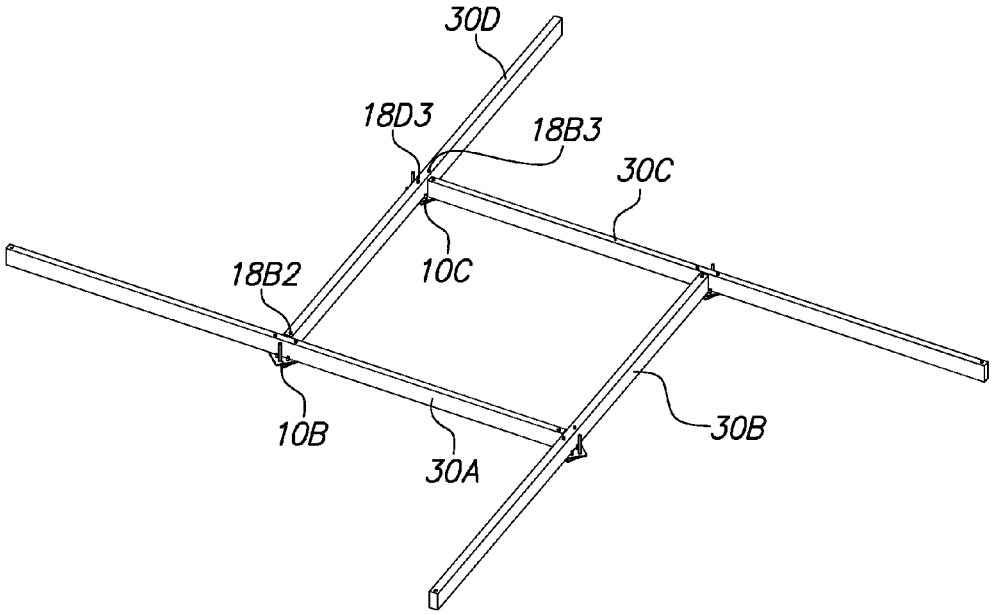
FIG. 8 shows a perspective view of one embodiment of the present invention.

Turning to FIG. 8, a user next places fourth stringer 30D perpendicular to third stringer 30C on third pedestal 10C such that the fourth stringer third hole fits over third pedestal second threaded rod 18B3 and the fourth stringer fourth hole fits over third pedestal fourth threaded rod 18D3 on third pedestal 10C. Then the user places the fourth stringer fourth hole over fourth pedestal second threaded rod 18B2 on fourth pedestal 10D.

Turning to FIG. 9, a user next places angular support 40. Angular support 40 is a support with a first end comprising a first right angle and a first angular support hole. Angular support 40 further comprises a second end comprising a second right angle and a second angular support hole. In this embodiment, a user places angular support 40 between third pedestal 10C and first pedestal 10A by placing the first angular support hole over third pedestal first unthreaded rod 20A3. A user then places the second angular support hole over first pedestal third unthreaded rod 20C1.

Each pedestal 10 has two stringers 30 that terminate at the pedestal 10 and one stringer 30 which passing through two threaded rods 18 separated by a diagonal distance. This geometry has many advantages over the prior art, and particularly Irish and its progeny. Embodiments of the present invention can be used as a blast floor by selecting materials particularly resistant to shattering such as metal. The present construction allows for even point loading to be dispersed across multiple pedestals 10. In addition to strength it also promotes the stage floor acting as a continuous membrane in flexion instead of simply connected discrete squares as in Irish. This greatly improves blast response to irregular loading found in blasting. For example, the floor in Roen, may lift and deflect under severe blast loading, but embodiments of the present invention will resist the floor coming apart, and thus causing potentially lethal missile hazards. The floor grid also works to prevent "noticeable deflection" which the present application defines as a deflection of more than one inch per 100 feet.

Figure 10:
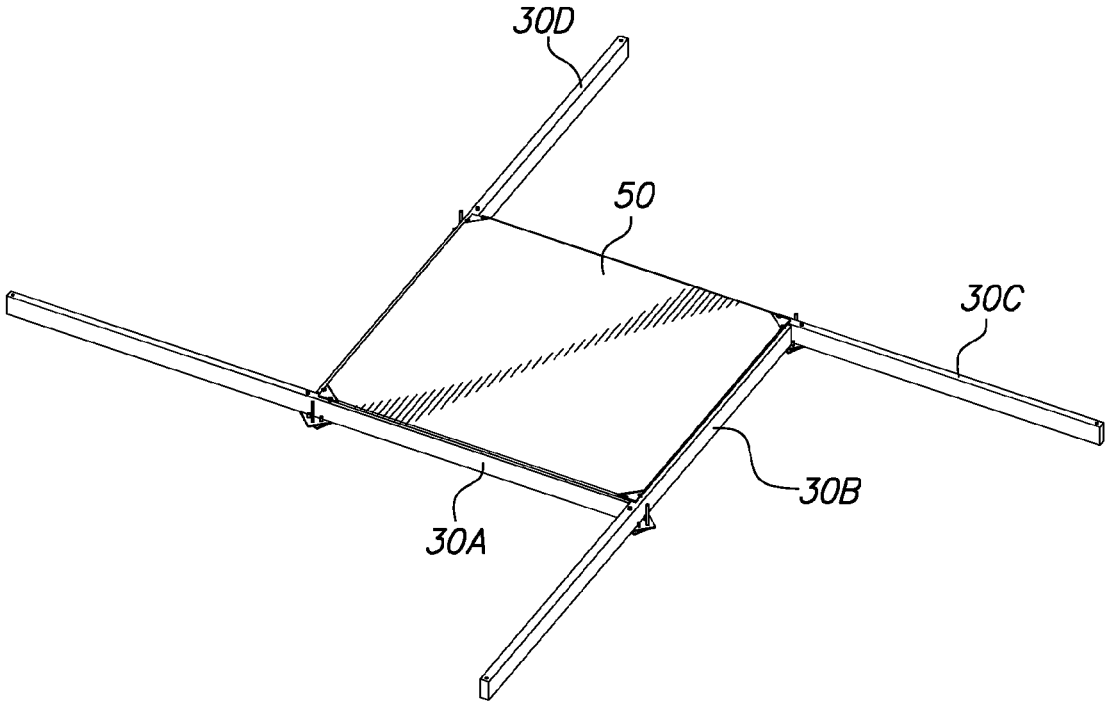
FIG. 10 shows a perspective view of one embodiment of the present invention.

In FIG. 10, a user places deck plate 50 onto first stringer 30A, second stringer 30B, third stringer 30C and fourth stringer 30D to create a level surface. Deck plate 50 is shown here with a somewhat octagonal shape that contains a lowered portion proximate each corner to enable access to pedestal 10. There are perforations in each lower portion that can permit partial access to threaded rods 18 and rotation nut 22. Angular support 40 is immediately adjacent to unthreaded pedestal rod 20 and unthreaded cover rod unthreaded cover rod 68.

Turning to FIG. 11, a user can adjust the height of any pedestal plate 12 by adjusting the corresponding rotation nut 22 to ensure that deck plate 50 is level, even if the ground is not level, for instance, if the stage floor assembly is assembled outdoors upon a lawn. Further, the interconnected nature of the grid network will promote continuity of the stage floor assembly tending to smooth out local differences in the grade elevation from one pedestal 10 to another. This helps avoid ridges or kinks on the surface of the stage floor assembly. This is in direct contrast to Hubbard, which teaches loading about a central point, as opposed to dispersed loading at a plurality of pedestals 10. While Hubbard theoretically works in earthquakes, it possesses no theory of how to handle blasts that would cause extreme bending moments at the outskirts of its device. The stage floor assembly is designed to work well in earthquakes under a contrary theory of dispersing vibration, as opposed to centralizing vibration in one node.

FIG. 12 shows the final stage of assembly around third pedestal 10C. Here, first deck plate 50A is placed on top of third stringer 30C and fourth stringer 30D. First deck plate 50A is immediately adjacent to second deck plate 50B and fourth deck plate 50D. Second deck plate 50B is further immediately adjacent to third deck plate 50C. Third deck plate 50C is further immediately adjacent to fourth deck plate 50D.

First deck plate 50A is perforated with first deck plate hole 52A which permits first unthreaded cover rod 68A to travel through first deck plate 50A into angular support 40 in place. Likewise, second deck plate 50B is perforated with second deck plate hole 52B which permits second unthreaded cover rod 68B to travel through second deck plate 50B. Additionally, third deck plate 50C is perforated with third deck plate hole 52C which permits third unthreaded cover rod 68C to travel through third deck plate 50C. Fourth deck plate 50D is perforated with fourth deck plate hole 52D which permits third unthreaded cover rod 68D to travel through fourth deck plate 50D.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A stage floor assembly configured to be easily assembled, aligned and adjusted even on an uneven surface, the stage floor assembly comprising;

a plurality of pedestals with each pedestal further comprising a pedestal base mechanically coupled to a plurality of rods;

a plurality of stringers each having at least one hole therein placed upon and receiving at least one of the plurality of rods;

a grid network further comprising:

at least two of the stringers having at least one distal point at each pedestal; and at least one of the stringers having at least two holes receiving at least two of the rods on at least one of the pedestals and extending across the at least one pedestal;

wherein the grid network self-aligns even on the uneven surface; and a plurality of deck plates attached to the plurality of stringers creating a surface to absorb and distribute loads across the plurality of pedestals preventing noticeable deflection across the stage floor assembly.

2. The stage floor assembly of claim 1, further comprising a threaded nut mechanically coupled to the pedestal base proximate a pedestal base hole bored in the pedestal base; and a pedestal foot is mechanically coupled to a threaded rod which is threaded through the threaded nut to adjust a distance from the pedestal foot to the pedestal base.

3. The stage floor assembly of claim 1, further comprising, a threaded nut mechanically coupled to the pedestal base proximate a pedestal base hole bored in the pedestal base; and a pedestal foot is mechanically coupled to a threaded rod which is threaded through the threaded nut; and a rotation nut mechanically coupled to the threaded rod which enables adjustment of a distance from the pedestal foot to the pedestal base from above the pedestal base.

4. The stage floor assembly of claim 1, further comprising wherein the plurality of rods further comprises a plurality of threaded rods and a plurality of unthreaded rods; and the plurality of threaded rods is mechanically coupled to a pedestal cover with threaded fasteners in order to keep the stage floor assembly at a consistent height.

5. The stage floor assembly of claim 1, wherein the plurality of pedestals comprises a first and second pedestal;

wherein the at least one of the plurality of rods of the first pedestal comprises a first rod; and wherein the plurality of rods of the second pedestal comprises a second rod;

the stage floor assembly further comprising:

an angular support mechanically coupled to the first rod on the first pedestal and the second rod on the second pedestal in order to align the first pedestal to the second pedestal as well as to disperse loading from the first pedestal and the second pedestal.

6. The stage floor assembly of claim 1, further comprising wherein the plurality of pedestals comprises a first and second pedestal;

wherein the at least one of the plurality of rods of the first pedestal comprises a first rod; and wherein the plurality of rods of the second pedestal comprises a second rod;

wherein the plurality of rods further comprises a plurality of threaded rods and a first plurality of unthreaded rods;

the plurality of threaded rods is mechanically coupled to a pedestal cover with threaded fasteners in order to keep the stage floor assembly at a consistent height;

an angular support mechanically coupled to the first unthreaded rod on the first pedestal and the second unthreaded rod on the second pedestal in order to align the first pedestal to the second pedestal as well as to disperse loading from the first pedestal and the second pedestal;

the plurality of stringers are connected to the threaded rods; and the pedestal cover is further mechanically coupled to a second plurality of unthreaded rods in order to match the first plurality of unthreaded rods to better secure the angular support;

wherein the stage floor assembly distributes loads from the pedestals to the plurality of stringers and the angular support to resist damage during blasting.

7. A pedestal configured to provide vertical support for stringers and an angular support used in constructing a stage floor, the pedestal comprising;

a pedestal base mechanically coupled to a plurality of rods wherein the rods are spaced to accommodate stringers and the angular support;

a threaded nut mechanically coupled to the pedestal base proximate a pedestal base hole bored in the pedestal base; and a pedestal foot is mechanically coupled to a threaded rod which is threaded through the threaded nut to adjust a distance from the pedestal foot to the pedestal base;

wherein the plurality of rods further comprises a plurality of threaded rods and a plurality of unthreaded rods; and the plurality of threaded rods is mechanically coupled to a pedestal cover with threaded fasteners in order to keep the stage floor at a consistent height.

8. The pedestal of claim 7, further comprising, a rotation nut mechanically coupled to the threaded rod which enables adjustment of the distance from the pedestal foot to the pedestal base from above the pedestal base.

9. A method of assembling a stage floor, configured to allow a user to assemble, align and adjust the stage floor, the method comprising:

placing a first pedestal, a second pedestal, a third pedestal and a fourth pedestal spaced apart from one another on ground in a location where a stage floor is desired;

providing a first stringer, a second stringer, a third stringer, and a fourth stringer, each stringer having a center portion with at least two center holes in the center portion thereof and at least one end hole at each end thereof;

wherein each pedestal further comprises: a pedestal base mechanically coupled to a plurality of rods; wherein the plurality of rods further comprises a plurality of threaded rods and a plurality of unthreaded rods;

connecting the first pedestal and the fourth pedestal with the first stringer such that the first stringer extends across the fourth pedestal and the first stringer center holes each receive at least one fourth pedestal threaded rod and the first stringer terminates at the first pedestal and one of the first pedestal threaded rods is received in one of the end holes of the first stringer;

connecting the first pedestal and the second pedestal with the second stringer such that the second stringer extends across the first pedestal and the second stringer center holes each receive at least one first pedestal threaded rod and terminates at the second pedestal and one of the second pedestal threaded rods is received in one of the end holes of the second stringer;

connecting the second pedestal and the third pedestal with the fourth stringer such that the third stringer extends across the second pedestal and the third stringer center holes each receive at least one second pedestal threaded rod and terminates at the third pedestal and one of the third pedestal threaded rods is received in one of the end holes of the third stringer;

connecting the third pedestal and the fourth pedestal with the fourth stringer such that the fourth stringer extends across the third pedestal and the fourth stringer center holes each receive at least one third pedestal threaded rod and terminates at the fourth pedestal and one of the fourth pedestal threaded rods is received in one of the end holes of the fourth stringer;

attaching a deck plate to at least one of the first pedestal threaded rods, at least one of the second pedestal threaded rods, at least one of the third pedestal threaded rods, at least one of the fourth pedestal threaded rods.

10. The method of claim 9, further comprising;

connecting the third pedestal and the first pedestal with an angular support such that the angular support terminates at both one of the third pedestal unthreaded rods and one of the first pedestal unthreaded rods.

11. The method of claim 9, further comprising;

adjusting a height of the first pedestal, the second pedestal, the third pedestal and the fourth pedestal to ensure the deck plate is level.

* * * * *